US006111364A

United States Patent [19]

Davis et al.

[11] Patent Number: 6,111,364

[45] Date of Patent: Aug. 29, 2000

[54] METHOD AND DEVICE TO INHIBIT THE FLASH PHOTOGRAPHY OF A VEHICLE

[76] Inventors: Jerry L. Davis; Steven S. Davis, both of 3768 Perry St., Denver, Colo. 80212

[21] Appl. No.: 09/071,002

[22] Filed: Apr. 10, 1998

[51] Int. Cl.[7] ..... H05B 37/00

[52] U.S. Cl. ..... 315/241 P; 315/200 A; 315/227 R; 315/159; 315/77

[58] Field of Search ..... 315/129, 135, 315/136, 227 R, 200 A, 241 P, 159, 151, 149, 77, 82

[56] References Cited

U.S. PATENT DOCUMENTS

| | | | |
|---|---|---|---|
| 3,783,336 | 1/1974 | Vital et al. | 315/159 |
| 3,849,784 | 11/1974 | Holzapfel | 346/107 VP |
| 4,302,084 | 11/1981 | Greenwald et al. | 396/106 |
| 5,255,166 | 10/1993 | Gonzalez | 362/83.2 |
| 5,301,091 | 4/1994 | Chen | 362/83.2 |
| 5,422,543 | 6/1995 | Weinberg | 315/129 |

FOREIGN PATENT DOCUMENTS 2324858 11/1998 United Kingdom .

*Primary Examiner*—Haissa Philogene

[57] ABSTRACT

A device and method that inhibits the ability of photographic equipment from obtaining a recognizable picture upon its recording media, of areas of a vehicle equipped with this invention. The leading edge or beginning of the photographic equipment's photoflash is detected by the photoflash detector cicuit group (50). A xenon reply flash (30) is immediately output towards the photographic equipment's general location, for the remainder of the photographs exposure time, rendering sections of the photograph unrecognizable.

2 Claims, 3 Drawing Sheets

METHOD AND DEVICE TO INHIBIT THE FLASH PHOTOGRAPHY OF A VEHICLE

BACKGROUND OF THE INVENTION

1. Field of the Invention

This invention relates in general to vehicle illumination, more particularly to specific illumination emitted by a vehicle that inhibits flash photography of a vehicle.

2. Background Description of the Prior Art

Periodical publications and other news media pay large amounts of money for photographs of celebrities and other persons. One of the few locations unavoidable, and directly accessable to the public, is travel in a vehicle on public streets, roads, etc. Photographers determined to obtain valuable photographs of celebrities can do so by pursuing these persons as they travel public thoroughfares in their vehicles. Inherently the extent to which the photographers pursue celebrities and the extent to which celebrities attempt to avoid the photographers, can produce dangerous and fatal results.

Using a specific flash photography method, photographers may, take pictures of the person or celebrity they seek, traveling in a vehicle. The method they use is simple; their camera's use a polarizing lens to remove the glare and reflections from the vehicle windows that would normally interfere considerably with the taking of a photograph. Since the interior of a vehicle is somewhat dark and use of this polarizing lens tends to further darken a picture. The photographer usually requires further illumination of the vehicle's interior, allowing the picture and subject to have sufficient exposure. A photographer may provide adequate illumination of their subjects, by the use of a photoflash aimed at the celebrity or person on the interior of the vehicle, as the exposure of the picture begins.

However, with all of the resourses available to these often very wealthy celebrities, no device is presently known which inhibits photographers from taking unwanted pictures of these celebrities or other persons in their vehicles on public thoroughfares. In the absence of such technology, the Congress of the United States of America has also considered legislation which might reduce this type of predatory photography.

Short duration, high power vehicle lighting has been in use and known for many years, such as in strobe lighting to illuminate emergency vehicles. Some of the more recent devices for vehicle illumination is the neon license plate illuminator of Chen U.S. Pat. No. 5,301,091 and Gonzalez U.S. Pat. No 5,255,166; which both illustrate the use of a neon or other gas lamp tube to illuminate a vehicle license plate for night driving. Whatever the precise merits, features and advantages of the above cited references, none of them achieves or fulfills this invention's objective of hindering or inhibiting unwanted photographs of a vehicle or its occupants, using flash photography.

SUMMARY OF THE INVENTION

The principle objective of the present invention is to provide a device that inhibits the ability of photographic equipment utilizing a photoflash, from obtaining a recognizable picture upon its recording media, of selected areas of a vehicle that is properly equipped with and operating this invention. This invention should also be mounted on, attached to, or carried in or on a vehicle and in such a way as to have the flash detection sensor and reply flash output illumination components visually accessible from the exterior of the vehicle. It would also be desirable if the invention is inexpensive, simple to install in a vehicle, and visually unobtrusive.

The invention accomplishes the principle objective by using the beginning or leading edge of the photoflash that the unwanted photographic equipment uses to illuminate the vehicle and its occupants, for proper exposure. The invention's flash detection circuit detects the leading edge of this photoflash. The flash trigger group then uses this detection signal to trigger and conduct power, converted from the vehicles own elecrical system or a battery source. The converted power which is conducted through the reply flash, produces brilliant illumination for a short period of time, usually less than a few seconds. The reply flash comprises a plurality of fast-on reply photoflash or other high speed, high intensity light sources such as a xenon photoflash tube, an arc lamp, etc. The output of the reply flash's illumination is aimed and/or reflected towards the source of the original photographic equipment's photoflash. The length of time required to expose a photograph is considerably longer than the invention needs to detect the beginning of the photographic equipment's photoflash and turn on its reply flash. This means that the reply flash is on for a significant amount of the photographs exposure time. This reply flash adds a considerably excessive amount of illumination in and around the position it is located in, on the unwanted photograph. It is believed that this causes a severe contrast in lighting on the photograph's recording media, leaving most areas with a dimmer exposure while having the area surrounding the output of the reply flash overexposed and unrecognizable. As well it is believe that this will cause any automatic exposure control, if any on the camera being used, to misread the amount of light in the picture and end the exposure of the photograph upon the recording media prematurely, rendering it unidentifiable.

DESCRIPTION OF THE PREFERRED EMBODIMENT

Figure 1:
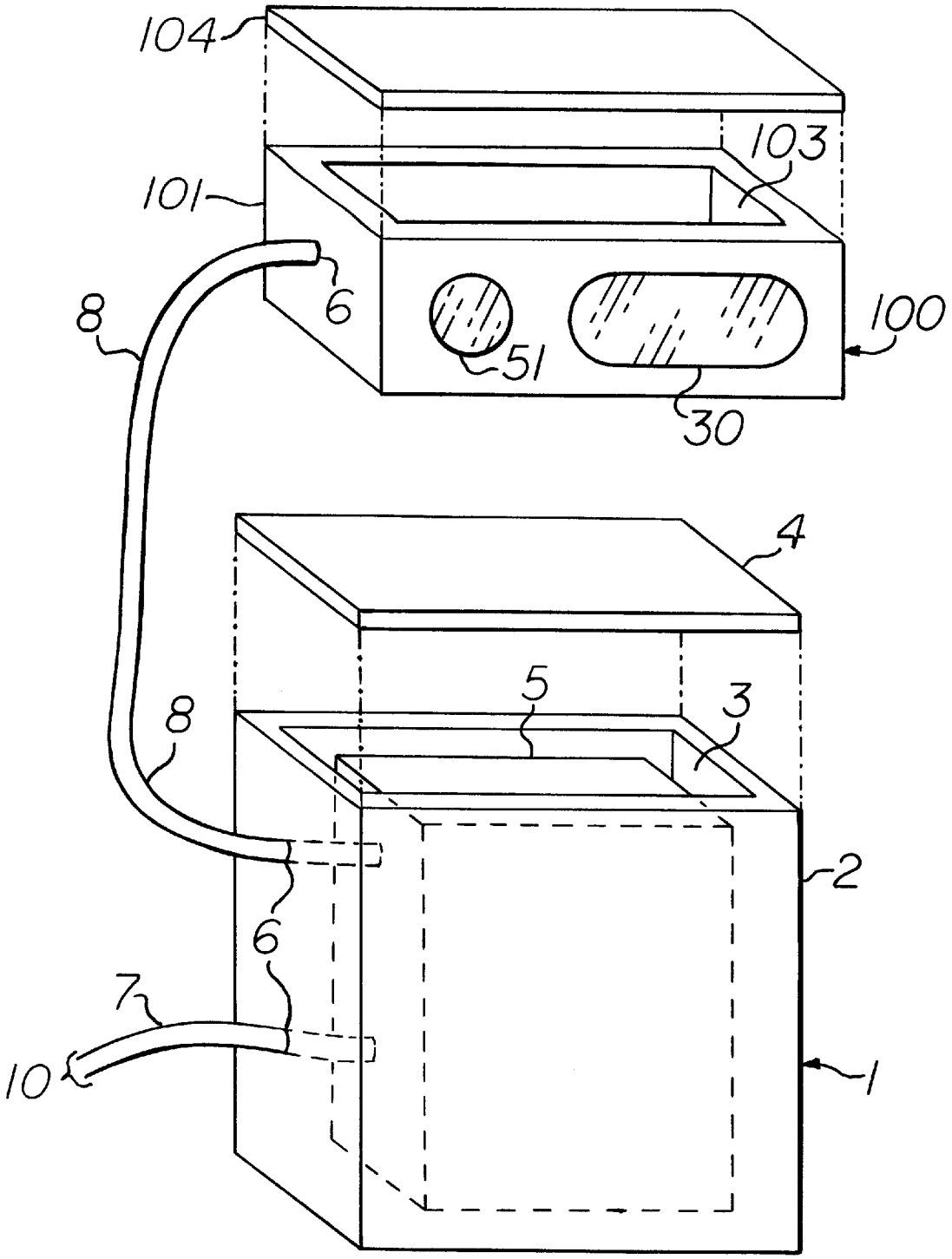
FIG. 1 is a perspective view of the device.

Referring now to the drawings and more particularly to FIG. 1, an enclosure 1 comprising; a housing 2 with a recessed compartment 3 to receive and enclose the electronic circuitry 5 of the device and a closure cover plate 4. Housing 2 and cover plate 4 being fastened together by adhesive (not shown). Housing 1 having perforations 6 to allow a set of electrical conductors 7 to be coupled with the vehicles electrical power supply 10. Housing 1 also having perforations 6 to allow electrical interconnections 8 to a transparent enclosure 100. Transparent enclosure 100 comprises, a transparent housing 101 with a recessed compartment 103 to receive electrical components and a cover plate 104. Housing 101 and cover plate 104 being fastened together by adhesive (not shown). The contents of enclosure 100, comprises the detection photo diode 51 and the reply photoflash tube 30. These are to be mounted, secured, or positioned on the vehicle in a location, so that the detection photo diode 51 can receive light projected toward the vehicle from a photoflash. The positioning of this enclosure 100 needs to also allow for the output illumination from the reply flash tube 30 to project outwardly and generally back towards the photographic equipment that originated the initial photoflash.

Figure 2:
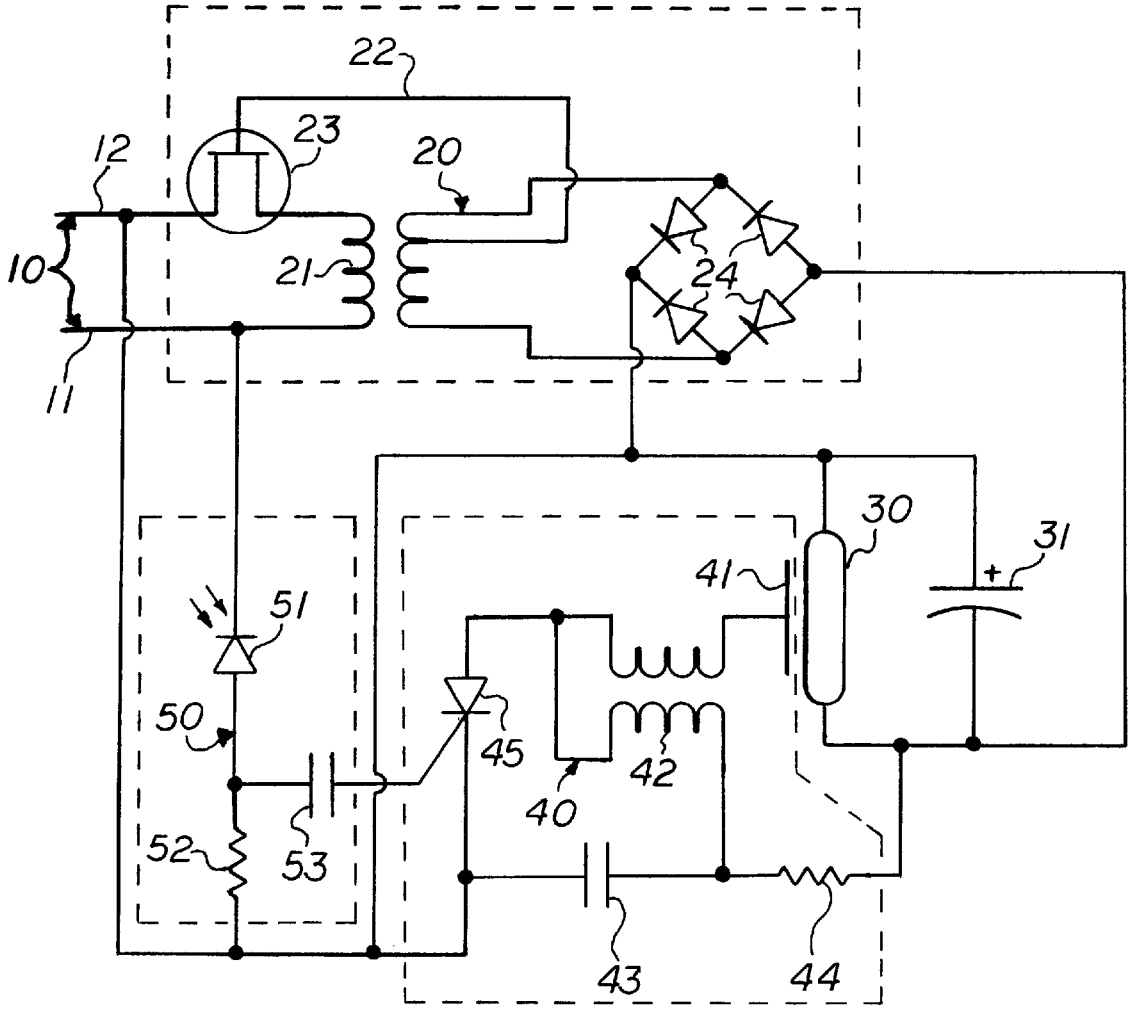
FIG. 2 is a detailed schematic diagram of the circuitry employed in the preferred embodiment.
Figure 3:
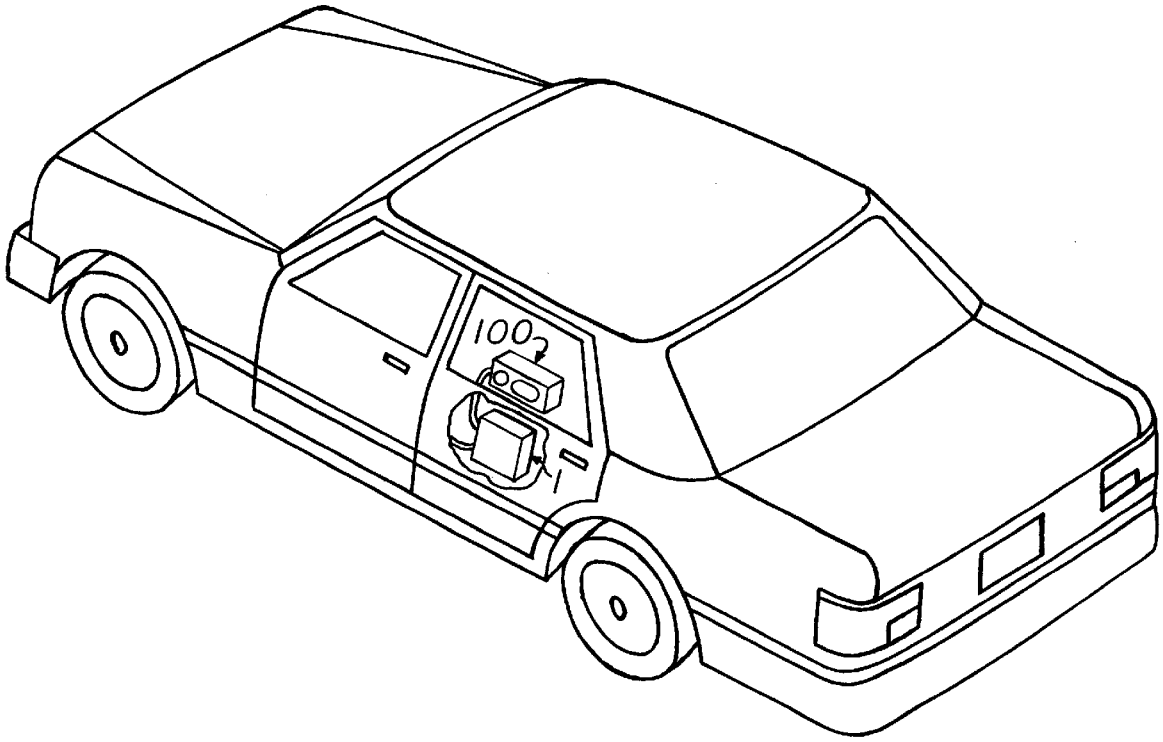
FIG. 3 is an installed view showing the device mounted in a side door and window of a vehicle.

Generally referring now to FIG. 2, a power converter group 20 whose purpose is to convert the input power supply 10 to power levels or specifications required by the photoflash capacitor 31 and xenon reply flash tube 30. The power converter group 20 is comprised a power supply 10, a transformer 21 with primary and secondary windings, a transistor 23 to vary the input power supply current, and a plurality of diodes 24. Power supply 10 is an electrical power source supplied by the vehicles electrical system, or its power can be supplied by a common battery. Transistor 23 is connected in series between the primary winding of the transformer 21 and the power supply 10. Transistor 23 varies the current from the power supply 10 through transformer 21. The base 22 of transistor 23 typically is connected to the windings of transformer 21 for feedback to vary the power supply current through transistor 23 and the primary winding of transformer 21. The secondary winding leads of transformer 21 are connected to a plurality of diodes 24 which form a rectifier for the ouput of transformer 21. The values of the components used in the power converter group 20 are selected to fulfill the power requirements of the photoflash capacitor 31 and the xenon reply flash tube 30.

The power converter group 20 is coupled to a photoflash capacitor 31 at its corresponding electrical connections. Power output of converter group 20 is used to charge the photoflash capacitor 31. The values of photoflash capacitor 31, are chosen to produce adequate current through the selected xenon reply flash tube 30, for a powerful flash with a duration usually lasting less than a few seconds. This will result in brilliant illumination from the xenon reply flash tube 30 for a significant period of the remainder of the photographic equipment's exposure time.

A xenon reply flash tube 30 is directly coupled to the corresponding poles of the photoflash capacitor 31. A xenon flash tube excitement lead 41 is placed in direct proximity to the body of the xenon reply flash tube 30, but at a sufficient distance from the connections of the xenon reply flash tube 30 to prevent accidental arcing to them. This arrangement will allow the output of trigger coil 42 to excite the interior of the xenon reply flash tube 30, when the coil 42 is triggered. The xenon flash tube excitement lead 41 should also be placed in proximity with the xenon reply flash tube 30, in a manner that does not significantly obstruct its output. The opposite end of the xenon flash tube excitement lead 41 is attached to a trigger coil 42, which comprises part of flash trigger group 40.

The flash trigger group 40 comprises a xenon flash tube trigger coil 42, a xenon flash tube excitement lead 41, a trigger capacitor 43, a trigger capacitor supply resistor 44, and an SCR 45. The trigger coil 42, comprises a high voltage transformer with primary and secondary windings. Trigger coil 42 has one lead of its primary and secondary windings attached to each other and the anode of SCR 45. The secondary winding lead, opposite that of the lead shared with the primary winding is attached to the xenon flash tube excitement lead 41 and extends closely to the proximity of the body of xenon reply flash tube 30. The end of the primary winding of trigger coil 42 opposite the connection with SCR 45, is attached to trigger capacitor 43 and trigger capacitor supply resistor 44. The opposing end of trigger capacitor 43 is attached to the negative power supply connection 12. While the opposite end of the trigger capacitor supply resistor 44 is attached to the negative side of the photoflash capacitor 31.

The detector circuit group 50 comprises a photo diode 51, a resistor 52, and a capacitor 53. The photo diode 51 is used to detect the output of a photoflash. This detection photo diode 51 is to be selected with sufficient size, to reliably detect the change in lighting supplied by a photoflash, even under conditions where there is a considerable amount of ambient illumination, such as during bright sunlight. The cathode of detection photo diode 51 is attached to the positive power supply connection 11. The anode of detection photo diode 51 is connected to detection signal capacitor 53 and detector resistor 52. The remaining lead of detector resistor 52 is attached to the negative power supply connection 12. Detection Photo diode 51 and detection resistor 52 combine to form a fight dependent voltage divider between the positive 11 and negative 12 power supply connections. The lead of the detection signal capacitor 53 opposite that of the connection with the anode of detection photo diode 51 and detection resistor 52, is attached to the gate of SCR 45. The cathode of SCR 45 being attached to the negative power supply connection 12. This forms a small signal current path between the positive power supply connection 11, through the detection photo diode 51 to the detection signal capacitor 53; where it can pass a small signal current through the gate and cathode of SCR 45 and on to the negative power supply connection 12. The SCR 45 should be selected to have the necessary gate sensitivity to allow conductance through SCR 45 when a small but sufficient signal is supplied through its gate from the detection signal capacitor 53.

Operation

In operation, power supplied from a vehicle's electrical system or a battery source is connected to its respective negative 12 and positive 11 terminals. This power is connected in series with transistor 23 and the primary winding of transformer 21. Using feedback from transformer 21, transistor 23 varies the current through the transformer's 21 primary winding. This produces a change in magnetic flux within the core of the transformer 21. A continual change in the magnetic flux of the core of transformer 21, induces a current flow through the secondary winding of transformer 21. As this embodiment is shown to utilize a vehicle's electrical system to supply power. The transformer 21 will require a turns ratio which converts the 12 volt operating voltage of an average vehicles electrical system, to that of approximately 250 volts used by commonly available xenon photoflash tubes shown used in this embodiment. The 250 volt output of the secondary winding of transformer 21 is rectified by the diodes 24. Photoflash capacitor 31 is charged by the rectified output of transformer 21 and diodes 24. The specifications for the photoflash capacitor 31 are selected to match the specific xenon flash tube chosen and the period of time it is desired to be illuminated. A change in component specifications, such as the xenon flash tube can require numerous changes in the values of other components. So their values are discussed in general. It should also be noted that the output of transformer 21 should be less than that needed for the continual conductance of the xenon reply flash tube 30. This is so that it will not glow continuously, but will stop and recharge and can be triggered again when needed. The photoflash capacitor 31 is directly connected to the matching terminals of the xenon reply flash tube 30. The xenon reply flash tube 30 will not directly conduct the current charge stored in the photoflash capacitor 31, because the interior of the xenon reply flash tube 30 does not have sufficient excitation to do so. It is the flash trigger group 40 that causes the xenon reply flash tube 30 to conduct the current charge and resultant energy stored in the photoflash capacitor 31. It accomplishes this by using the high voltage output of the trigger coil 42 to excite the xenon reply flash tube 30 when it is triggered. Some of the current of the photoflash capacitor 31 passes through trigger resistor 44 and charges the trigger capacitor 43. A potential current path exists from the trigger capacitor 43 through the SCR 45 to one end of the trigger coils primary winding and back to the opposite side of trigger capacitor 43. When SCR 45 is triggered and conducts the current charge stored in trigger capacitor 43, it produces a magnetic field in the trigger coil 42 core. This induces a high voltage through the excitement lead to the proximity of the xenon reply flash tube 30 body. Although there is no conductance between the terminals of the xenon reply flash tube 30 and excitement lead 41. This causes the xenon gas in the tube to be come very energized or excited and allow conductance of the stored current charge of photoflash capacitor 31 through the xenon reply flash tube 30. This conductance and resultant brilliant illumination will continue for a period of time until there is no longer sufficient charge and voltage stored in the photoflash capacitor 31 to travel between the contacts of the xenon reply flash tube 30, abruptly stopping it. The output of power converter group 20 will then charge the photoflash capacitor 31 to appropriate power levels, where it can discharge through xenon reply flash tube 30 again, when energized by the output of the trigger coil 42.

In order to trigger the SCR 45 to conduct the energy of trigger capacitor 43 through the trigger coil 42 a sufficient current must pass through the gate and cathode of the SCR 45. The detection photo diode 51 and detection resistor 52, form a light dependent voltage divider between the positive 11 and negative 12 power supply connections. Detection capacitor 53 is connected in between the photo diode 51 and detection resistor 52 and whose opposite side connects with the negative power supply connection 12 through SCR 45. This arrangement makes the voltage and charge upon detection capacitor 53 dependent on the light which strikes the photo diode 51. Most changes in the light that fills upon the photo diode 51 are relatively gradual. This causes a current to pass through the gate of SCR 45 that is too small to trigger conductance of the SCR 45. However when the illumination from EL photoflash strikes the photo diode 51, the abrupt increase in the change in light that falls upon the photo diode 51 in a small period of time, causes the detection capacitor 53 to pass a much larger amount of current through SCR 45. This triggers SCR 45 and causes it to conduct the stored current charge of trigger capacitor 43 through the trigger coil 42 and excite the xenon reply Rash tube 30 into conductance with the current charge stored in photoflash capacitor 31, producing a brilliant illumination as it does so. It should be noted that as the detector triggers from only the leading edge or beginning of a photoflash and requires a short amount of time to reset itself, there is little chance of it accidentally self-triggering.

Accordingly the reader will see the unique advantages offered by this invention to celebrities and other persons who do not wish to have the privacy of their vehicles violated by the use of specialized photographic equipment taking unwanted pictures of them.

While the above description contains many specificities, these should not be construed as limitations on the scope of the invention, but rather as an exemplification of one preferred embodiment thereof. The method used in this invention can be achieved by embodiments that are as numerous as those electrical parts available which can detect light upon them and those that can quickly supply a considerable amount of illumination in return In the future it might be possible for celebrities and others, to carry this technology on their persons to provide them with similar protection from unwanted flash photography.

Accordingly, the scope of the invention should be determined not by the embodiments illustrated, but by the appended claims and legal equivalents.

what is claimed is:

1. A method to inhibit photographic equipment utilizing a photoflash, from obtaining a completely recognizable photograph of a vehicle; said method comprising the steps of:

a) detecting the beginning of the photographic equipment's photoflash, and b) supplying immediate high output illumination, directed toward said photographic equipment for a significant period of the remainder of the photograph's exposure time, whereby causing excessive exposure of desired areas of said photograph, rendering them unrecognizable.

2. A method to inhibit photographic equipment utilizing a photoflash, from obtaining a completely recognizable photograph of a vehicle and its occupants; said method comprising the steps of:

a) detecting the beginning of the photographic equipment's photoflash, and b) supplying immediate high output illumination, directed toward said photographic equipment for a significant period of the remainder of the photograph's exposure time, whereby causing excessive exposure of desired areas of said photograph, rendering them unrecognizable.

* * * * *